United States Patent [19]

Buchanan et al.

[11] 4,386,637

[45] Jun. 7, 1983

[54] CHEMICAL DRUM FEEDING AND FLUSHING SYSTEM

[75] Inventors: William T. Buchanan, Oak Brook; Frances C. Pocius, Lombard; Donald L. Peters, Naperville, all of Ill.

[73] Assignee: Nalco Chemical Company, Oak Brook, Ill.

[21] Appl. No.: 282,889

[22] Filed: Jul. 13, 1981

[51] Int. Cl.[3] ..... B67C 9/00; B67C 1/06

[52] U.S. Cl. ..... 141/65; 141/85; 134/166 R; 134/167 R; 134/168 R; 137/888; 222/49; 222/148; 222/192

[58] Field of Search ..... 141/85–92, 141/98, 7, 65, 66; 222/129.2, 49, 133, 148, 192; 137/888; 134/166 R, 167 R, 168 R

[56] References Cited

U.S. PATENT DOCUMENTS

| | | | |
|---|---|---|---|
| 818,481 | 4/1906 | Spencer | 222/49 |
| 1,642,920 | 9/1927 | Cooper | 222/49 |
| 1,795,763 | 3/1931 | Cramer et al. | 134/167 R |
| 2,039,275 | 4/1936 | McGrael | 137/888 |
| 2,562,415 | 7/1951 | Chase | 137/888 |
| 2,679,851 | 6/1954 | Schira | 134/166 R |
| 4,187,957 | 2/1980 | Butler | 222/49 |
| 4,285,445 | 8/1981 | Molen et al. | 222/49 |

*Primary Examiner*—Houston S. Bell, Jr.

*Attorney, Agent, or Firm*—John G. Premo; Robert A. Miller

[57] ABSTRACT

An apparatus for safely slug feeding hazardous chemicals from conventional 55 gallon drums comprising a calibrated dip tube adapted to be moved in an up and down liquid-tight relationship through a first bung hole of the drum, a feed line adapted to remove liquid through the calibrated dip tube, check valve means adapted to prevent the flow of liquid into the drum, vacuum-producing means adapted to withdraw fluid from the drum through the dip tube, feed line, and check valve, and cleaning means adapted to be partially positioned within the drum through a second bung opening, said cleaning means including a spray nozzle positioned within the drum and air ventilation means outside of the drum, said spray means being adapted to receive a source of cleaning fluid under pressure. The dip tube may be fitted with a means for preventing its upward movement.

2 Claims, 1 Drawing Figure

CHEMICAL DRUM FEEDING AND FLUSHING SYSTEM

Figure 1:
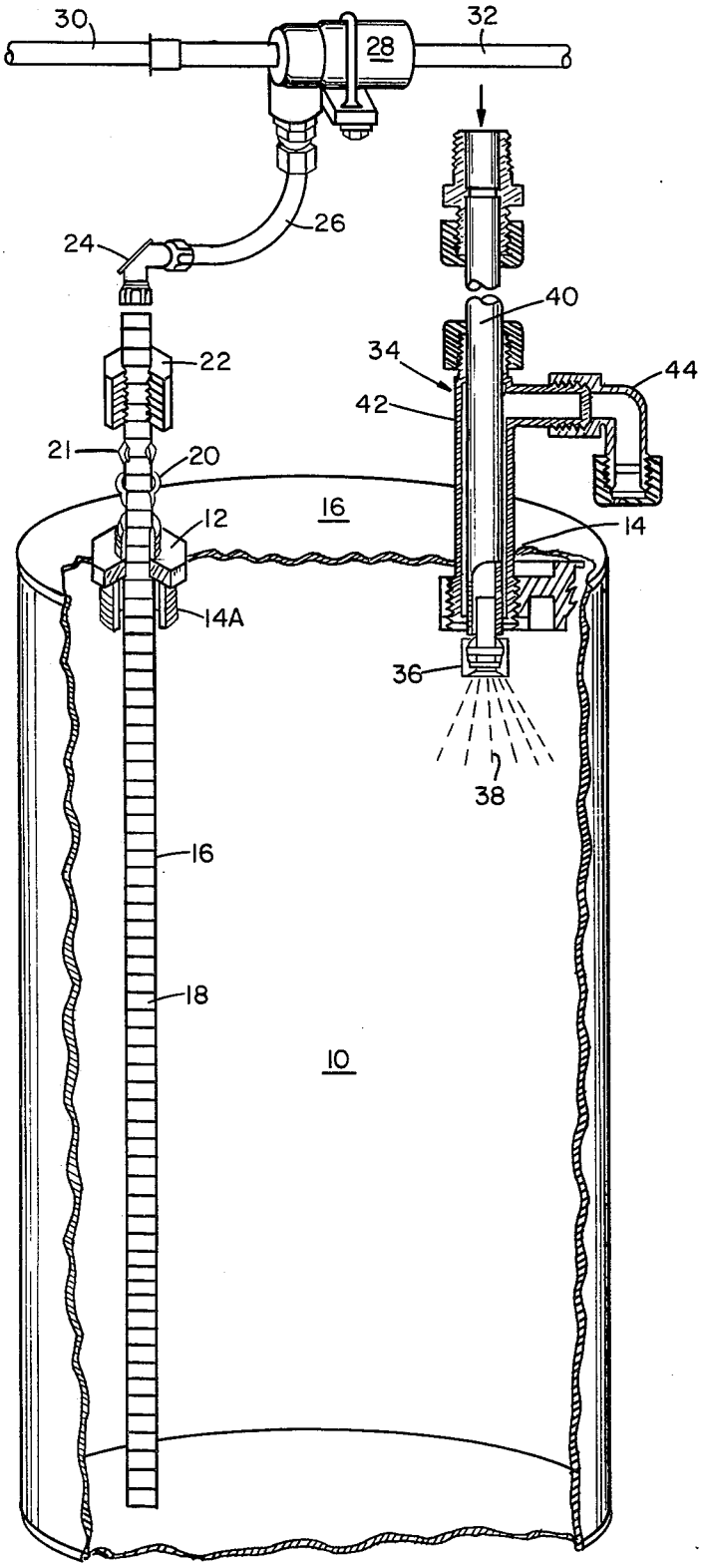

It is common to use toxic chemicals in a variety of industrial applications such as treating paper mills, cooling towers, and the like. Typical toxic chemicals are, for example, microbiocides.

These hazardous materials are often supplied in the form of liquids and are contained in conventional 55 gallon steel drums. Oftentimes, when these drums are opened by non-trained chemical workers, a portion of the contents will be spilled on personnel and can cause harm unless proper protective clothing, etc. are worn.

If it were possible to provide a feeding system in which it were possible to safely feed the contents of these drums without the chemical contacting the operator, and, upon the drum being empty, allow it to be cleaned of its toxic contents so that it could be safely handled, a valuable contribution to the art would be afforded.

THE DRAWING

For a better understanding of the invention, reference may be had to the drawing which is a vertical view cutaway in part of a drum fitted with various devices used in the system of the invention.

THE INVENTION

With specific reference to the drawing, there is shown a conventional 55 gallon drum 10 which has a conventional first bung opening 12 and a second bung opening 14 positioned in the top 16 of the drum. The first bung 12 of the drum normally is fitted with a screw cap which has been removed and, inserted in its place, is threaded bushing 14A which is adapted to receive the hold calibrated dip tube 16. The dip tube contains calibrations 18 throughout most of its length. The dip tube, by means of compression ring 20 and threaded adapter 22, may be held in liquid-tight relationship with respect to the threaded bushing 14A. Dip tube 16 may be fitted with a gripper 21 or other means for preventing upward movement of the dip tube, if desired.

The upper end of the calibrated dip tube is fitted with a 90° L 24 which contains therewithin a ball-type check valve, not shown, which allows fluid flow only in an upward direction. The other end of the L 24 is connected through line 26 to a suitable vacuum-producing device which, in the case of the drawing, is illustrated as being eductor 28. Eductor 28 has water flowing through lines 30 and 32 which creates a vacuum, allowing fluid to flow from the drum through line 26 and into line 32. This allows hazardous chemical contained within the drum to flow through the line to its ultimate point of application such as a cooling tower basin, paper mill system, or the like.

The second bung 14 is fitted with a spray device generally designated by the numeral 34. The bottom portion of the device is a spray nozzle 36 capable of forming a spray of water 38 capable of washing the inner surfaces of the drum 10. The upper portion of the spray device 34 is fitted with a water line not shown which supplies water under pressure to nozzle 36. The nozzle 36 is fitted to a suitable conductor 40 which conducts the water to the pipe. This pipe is contained within chamber 42 which communicates through L 44 to the outside air. The chamber 42 also communicates with the interior of the drum. This allows air to be vented from the drum to prevent pressure or vacuum buildup from occurring.

In operation, the operator wishing to empty the contents of drum 10 would insert the dip tube 16 into bung opening 12 in which bushing 14A has been placed and the spray device 34 into bung opening 14. The hose 26 from dip tube 16 would be connected to the eductor 28 and a water line would be connected to the spray device 34.

The calibrations 18 on the dip tube 16 are such as to represent known fluid units such as pints, quarts, gallons, liters, etc. The tube would be lowered to a height such that only the desired liquid quantity as indicated by the calibration would be withdrawn from the drum. The eductor 28 would be actuated and liquid would be siphoned from the drum through dip tube 16 until the liquid level was below the bottom of the calibrated tube. When another quantity of liquid is desired from the drum, the calibrated tube would be lowered into the drum to the desired depth. This would be repeated until the drum was empty. At that time, the eductor would be turned off. A fluid such as water would then be fed under pressure to spray unit 34 and through spray nozzle 36 which would produce water spray 38 which would wash the drum. Washing would be continued until the drum was filled. The eductor 28 would then be turned on and the wash fluid removed from the drum through calibrated tube 16, line 26 into eductor 28, line 32, and into drain, not shown. After this was completed, the eductor 28 would be turned off, and the spray device removed. The drum 10 can then be disposed of or returned to the manufacturer.

It is thus seen that the contents of the drum never have an opportunity to contact the operators or other personnel, yet, at the same time, contents may be simply slug fed as needed. After the contents of the drum are empty, it may be cleaned and the device removed and the drum then returned to the manufacturer or disposed of in a suitable fashion.

Having thus described our invention, it is claimed as follows:

1. An apparatus for safely slug feeding hazardous chemicals from conventional drums having first and second top bung openings comprising in combination with the drum:

(a) a threaded bushing screwed into the first bung opening adapted to receive and hold a disposable calibrated dip tube in a liquid-tight relationship, the dip tube adapted to be movable in a downward direction only, a feed line attached to the dip tube adapted to remove liquid from the drum through the calibrated dip tube, check valve means located in said feed line adapted to prevent the flow of liquid back to the drum, through the dip tube, vacuum-producing means connecting with the feed line for withdrawing fluid from the drum through the dip tube feed line and check valve; and, (b) spray means fitted into the second bung opening, spray means having means for allowing outside air to flow into the drum to prevent pressure and/or vacuum buildup from occurring in the drum, nozzle means positioned in the drum for washing the interior surfaces of the drum, said nozzle means adapted to receive a source of cleaning fluid under pressure, said spray means being removable from the drum.

2. The apparatus of claim 1 where the vacuum-producing means is an eductor.

* * * * *